US010414544B2

(12) United States Patent
Fischer et al.

(10) Patent No.: US 10,414,544 B2
(45) Date of Patent: Sep. 17, 2019

(54) CLUSTER PACK COMPRISING LABELLED CONTAINERS

(71) Applicant: KHS GmbH, Dortmund (DE)

(72) Inventors: Mathias Fischer, Kevelaer (DE); Uwe Hoffmann, Böbingen an der Rems (DE)

(73) Assignee: KHS GmbH, Dortmund (DE)

( * ) Notice: Subject to any disclaimer, the term of this patent is extended or adjusted under 35 U.S.C. 154(b) by 116 days.

(21) Appl. No.: 15/519,557

(22) PCT Filed: Jan. 7, 2016

(86) PCT No.: PCT/EP2016/050238

§ 371 (c)(1),
(2) Date: Apr. 17, 2017

(87) PCT Pub. No.: WO2016/113183

PCT Pub. Date: Jul. 21, 2016

(65) Prior Publication Data

US 2017/0253375 A1 Sep. 7, 2017

(30) Foreign Application Priority Data

Jan. 12, 2015 (DE) ..... 10 2015 100 343

(51) Int. Cl.

| | |
|---|---|
| ***B65D 21/02*** | (2006.01) |
| ***B65D 23/08*** | (2006.01) |
| ***B65D 25/36*** | (2006.01) |
| ***B65C 3/08*** | (2006.01) |
| *B65B 17/02* | (2006.01) |

(52) U.S. Cl.
CPC ..... *B65D 21/0205* (2013.01); *B65C 3/08* (2013.01); *B65D 23/085* (2013.01); *B65D 25/36* (2013.01); *B65B 17/02* (2013.01)

(58) Field of Classification Search
CPC ..... B65C 3/08; B65D 21/02; B65D 21/0205; B65D 25/36; B65D 71/06; B65D 71/08; B65D 71/50; B65B 17/02; B65B 21/24
USPC ..... 206/139–201, 459.5, 460; 220/23.2, 220/23.8, 23.83, 23.86
See application file for complete search history.

(56) References Cited

U.S. PATENT DOCUMENTS

| | | | | |
|---|---|---|---|---|
| 3,275,134 A * | 9/1966 | Bixler | ..... | B65D 71/50 206/145 |
| 9,090,389 B2 * | 7/2015 | Kettwig | ..... | B65D 71/08 |
| 2015/0034503 A1 * | 2/2015 | Kettwig | ..... | B65D 71/508 206/139 |

FOREIGN PATENT DOCUMENTS

| | | |
|---|---|---|
| DE | 10 2009 025824 | 11/2010 |
| DE | 10 2011 119966 | 11/2012 |
| DE | 10 2012 005 925 | 11/2012 |
| DE | 10 2012 100 810 | 6/2013 |
| WO | WO01/87722 | 11/2001 |

* cited by examiner

*Primary Examiner* — Bryon P Gehman
(74) *Attorney, Agent, or Firm* — Occhiuti & Rohlicek LLP

(57) ABSTRACT

A cluster pack with at least two containers, each of which each container carries a label. One or more glued joints interconnect the containers. At least one of the glued joints is applied in a cut-out section of a label.

18 Claims, 2 Drawing Sheets

CLUSTER PACK COMPRISING LABELLED CONTAINERS

RELATED APPLICATIONS

This is the national stage under 35 USC 371 of international application PCT/2016/050238, filed on Jan. 7, 2016, which claims the benefit of the Jan. 12, 2015 priority date of German application DE 102015100343.0, the contents of which are herein incorporated by reference.

FIELD OF INVENTION

The invention relates to container packaging, and in particular, to cluster packs.

BACKGROUND

It is known to glue containers together to form cluster packs. The spots at which the glue joins containers are often called "glue joints."

Containers frequently carry labels. The force holding the label to the container is often weaker than the force that would result from gluing directly to the container. Therefore it is preferable to form the glue joints so that the glue bonds directly to the container, and not to the label.

A difficulty that arises is that sometimes labels are quite large. Very often, they go all the way around the container. This means that many of the locations at which one might want to form the glue joints are covered by the label. Since the glue joints would then be formed on the label and not directly on the container, the bond will not be as strong.

The use of a large label therefore makes it difficult to join containers with glue because the label eaves fewer places available to form glued joints of adequate strength.

SUMMARY

An object of the invention is to provide a larger surface on which one can arrange glued joints even on a container with a label.

A cluster pack according to the invention comprises at least two containers. These containers carry a label. A glued joint connects the container. The label has a cut-out section, such as a circular or elliptical hole. It is through this hole that the glued joint is formed.

The invention is based in part on a recognition that one can cut out small sections of a label without significantly detracting from their value as labels. This is particularly true for those portions of a label that are on the rear side of containers. This is particularly fortuitious because when making a cluster pack, one can orient the containers so that the rear side of the labels faces inwards and cannot be seen by the consumer. Given that the customer's attention is mostly directed to the front of the label, it is not impractical to form cut-outs from those portions of the label that enjoy less of the customer's attention.

The invention is further based on the recognition that glued joints for connecting containers require only small surface areas and that they can also be placed with precision. This makes it possible to have very small and inconspicuous cut-out sections. In some embodiments, the cut-out sections make up no more than 20% of a label's surface. However, there are also embodiments in which the cut-out sections amount to no more than 10% of the label's surface, and embodiments in which they are no more than 5% of the label's surface. A cut-out section of this size does not significantly undermine the label's function. Even with such inconspicuously placed cutouts, sufficient area remains to provide provide publicity or other product-related information on the label.

The invention thus permits glued joints to be placed anywhere on the container, including those areas that were formerly off limits because of the presence of a label. As a result, it is possible to place adhesive spots at any desired point of the container wall, in particular on the rear side or on the side walls of a container.

According to a preferred embodiment of the invention, the cut-out section is larger than the glued joint, advantageously by at least 10%, preferably by at least 20%, and in particular by at least 50%.

In some embodiments, the cut-out section is a hole in the label. In others, it is a notch at the edge of the label. A mere slot or cut in the label is not, as a rule, sufficient to guarantee that the glued joint will ultimately connect the containers with one another. Formation of a cut-out section typically requires that material be removed from the label.

The invention is particularly well-suited for applications in which the glued joint is in the lower half of the container. It is specifically here that a substantially larger region of the container wall opens up for the arrangement of glued joints. The further the glued joint is placed towards the lower end of the container, the less force is required to separate the container from the cluster pack. This is because, if the container is grasped at the upper end, and if the glued joint which is arranged in the lower half, as close as possible to the lower end of the container, the consumer can exercise considerably leverage.

A container of a cluster pack can be connected to adjacent containers by two or more glued joints. In some embodiments, the label has as many cut-out sections as glued joints have been applied to the container. In this situation, every cut-out section can have a different shape.

As used herein, the term "containers" refers to bottles, cans, tubes, or pouches, made in each case of metal, glass, plastic, and/or a material composite, typically, for example, PET bottles, or a material composite of plastic, aluminium foil, and paper. In general, the term ecompasses structures that are suitable for the filling of fluid or viscous products, as well as containers that have already been grouped together to form groups or multipacks. In some embodiments, containers of the cluster pack are arranged in non-nesting positions. In other embodiments, containers of a row of the cluster pack are not arranged in gaps formed in adjacent rows of the cluster pack.

Containers can have any desired cross-section. Embodiments include those in which containers have the common circular cross-section and the less common oval and angular cross-sections.

Containers can also have any of a variety of shapes. Examples of such containers are pouches, pyramidal containers, and cubic containers, as well as cylindrical containers, such as cans. Also included are containers with a non-uniform cross section, such as bottles that taper towards an opening. Also included are bottles that stand at lower ends thereof only on point-shaped support regions, and that have cross-sections that transition from the point-shaped support regions to the basic body and into the cylindrical bottle wall.

The containers that have been grouped into a cluster pack have, on the container wall, information. This information might be about the contents of the container. In some embodiments, the bottle carries a label that can be printed on or that has been pre-printed. A label can be a glued label which is configured as a one part label or a multi-part label, or as a banderol running around the container wall. Such a banderol can be glued to the container wall, but this is not necessary.

Glued joints that hold together the containers of a cluster pack are not placed on labels. This is because the bond between the label and the container is prone to tear at even a modest loading. This can happen, for example, when a plastic banderol is not glued or otherwise connected to the container wall. This can also happen when the label is fully glued on its entire surface to the container wll but the bonding strength of the paper fibres to one another is low enough so that hat parts of the label will detach from the container if too great a load is imposed. In general, labels on which glued joints are placed do not hold in place with sufficient reliability under the loads that are incurred during the transport of a cluster pack.

According to the invention, labels are therefore provided with a cut-out section. The introduction of the cut-out section can take place either as early as at the manufacture of the labels, or, as an alternative, the cut-out section is introduced immediately before the placing of the labels. The cut-out section can be produced, for example, by cutting or punching. It can be formed as a cut-out section of which the circumference is formed entirely by the label. It can also, however, be formed as an edge-side cut-out section, which intersects the outer edge of the label, such that the cut-out section is surrounded not only in sections by the label. The cut-out section can exhibit any desired shape, but is preferably circular or oval, because such cut-out sections are less inclined to lead to the label tearing outwards over the predetermined shape of the cut-out section. Other shapes are also possible, however, in particular angular shapes or irregular shapes, such as triangles, rectangles, or squares, but also polygons, stars, sickles, or other shapes, including irregular shaped, which can be produced as the cut-out section in a label. The cut-out section is preferably matched to the print applied to the label, in order not to detract from the aesthetic impression of the label.

As used herein, unless expressly indicated otherwise, the terms "glued joint," "glued point," "glued connection," etc. should not be understood as the application of glue as known in the prior art, in order to fix one or a plurality of labels on or at the container surface, for example by adhesively bonding the two ends of a label, as is often the case with a roll-feed label. These terms, "glued joint," "glued point," "glued connection," etc., should be understood exclusively as the direct glued connecting of containers to one another.

The production of a glued joint between two containers from a glued point applied onto one container is effected by pressing or compressing the two containers against one another so that the glue of the glued point connects the two containers at a glued point.

As used herein, "glue" and "adhesive" refer to substances, materials, and compounds that are are suitable for producing a glued joint between containers. These terms include substances, materials, or compounds that are applied in a fluid or viscous state, forming a self-adhering glued point. These terms also refer to substances, materials, or compounds that form a glued joint by the application of energy, such as by the application of pressure, radiation, or temperature, or by means of chemical hardening or cross-linking. A typical adhesive UV-hardening adhesives, which are also processed in the low-viscous state and can be hardened or cured by radiation. Another typical adhesive is hot glue, which cools after the application, and which loses its adhesive strength below a temperature that is typical for the material such that hot glue is only suitable for the direct production of a glued joint. Glues or adhesives also include multi-layer materials, such as those formed from at least one carrier material that has been coated with an adhesive in such a way that a glued joint can be produced between two containers. These multi-layer materials are typically formed as pads that have been formed to have an adhesive on its two sides.

A container formed with a glue point therefore comprises adhesive that is applied in point, along a line, or in a pattern of points and/or lines. Preferably, the selected adhesive has an adhesive strength that is low enough to permit containers to be detached by hand. A suitable adhesive is a UV-hardening adhesive. This is in part the adhesive strength which the adhesive develops at the glued joint can be readily adjusted by the composition of the adhesive and the intensity of hardening or curing.

Glue joints interconnect the cluster pack's containers. Preferably, the joints connect the containers to one another directly. In some embodiments, the glued joints represent the only connection between the cluster pack's containers. Preferably, the glue joints use as little glue as possible.

In other embodiments, a cluster pack has, at its upper end, a transport securing element. A suitable transport securing element is a strip-shaped transport securing element. In some embodiments, the transport-securing element extends to form a transport loop.

In either case, in a cluster pack as described herein, the glue holds the cluster together. This means it is not necessary to rely on any film wrapping or cardboard to hold the containers together into a cluster.

The application of glue or adhesive involves spraying or applying adhesive that has passed through a nozzle directly onto a container to form one or more adhesive points. This adhesive is usually fluid.

Once the adhesive has been applied, the containers are joined. This is typically carried out by clamping strips that bring containers into contact with each other. As a result, a glue joint between first and second containers forms at those locations at which an adhesive point has been applied onto the first container. It is possible to also apply glue to the second container at the same location so that when the clamping strips act, the two regions of glue contact each other and form a joint.

In another aspect, the invention features making a cluster pack by providing a first container, applying a label with a cut-out section, applying an adhesive point in the cut-out section after the container has been aligned beforehand in such a way that the adhesive point is applied in the cut-out section, providing a second container, and joining the first and second container to form a cluster pack.

Providing the first container takes place at a location at which the label, with the cut-out section according to the invention, is applied. After the application of the label, the container is aligned such that means for the application of adhesive at a predetermined location, namely in the cut-out section, will apply an adhesive point onto the first container. The alignment is carried out by rotating the container. The alignment takes place, for example, by detecting differences in brightness, light permeability, or reflection of the surface. After the alignment, an adhesive point is applied in the cut-out section, for example by spraying or pressing of adhesive out of an adhesive nozzle or by the application of a two-sided adhesive pad. The adhesive point is preferably smaller than the cut-out section. After the application of the adhesive point, or in parallel with this, a second container is provided. In a simple embodiment of the invention, the second container is produced in any desired format, but preferably with a label of the same type, likewise with a cut-out section, and, before the joining of the first and second containers, is aligned in such a way that an adhesive point occurs between the first and the second containers, in each case in the cut-out section of the label of both containers. In this way, both containers are connected to form a cluster pack. The method can be carried out with any desired number of containers, frequently four, six, or nine containers.

The label that is applied onto the first and, if appropriate, the second container, is either already provided at manufacture or directly after the application on the container of a cut-out section. The former method is particularly economical, and avoids arranging means for producing the cut-out section in the vicinity of the device for producing a cluster pack. The latter method has the advantage of being flexible in shape and placement, capable of being adjusted, for example, to the manner in which the cluster pack is to be produced in each case.

The invention further encompasses a device for producing a cluster pack according to the invention, which comprises, in an inherently known manner, means for aligning a container, means for applying a label, and means for applying an adhesive point, wherein the device according to the invention also comprises means for producing a cut-out section in a label, and wherein the device comprises means for aligning the container, which are arranged after the application of the label and which align a container in such a way that the means for applying an adhesive point take effect onto the cut-out section. Known devices for producing a cluster pack according to the invention do not provide such means for producing a cut-out section. The cut-out section can be produced by means or, respectively, by a tool which takes effect, for example, by cutting, punching, or by a hot wire, with which a piece of plastic is separated out of the label. Preferred are such means as produce a clean edge at the periphery of the label, while the selection of the tool for producing the cut-out section can be based on economical and technical production considerations such as, typically, costs, utilisation of energy and space, and time taken for producing a cut-out section.

BRIEF DESCRIPTION OF THE DRAWINGS

These and other features of the invention will be apparent from the following detailed description and the accompanying figures, in which.

DETAILED DESCRIPTION

Figure 1:
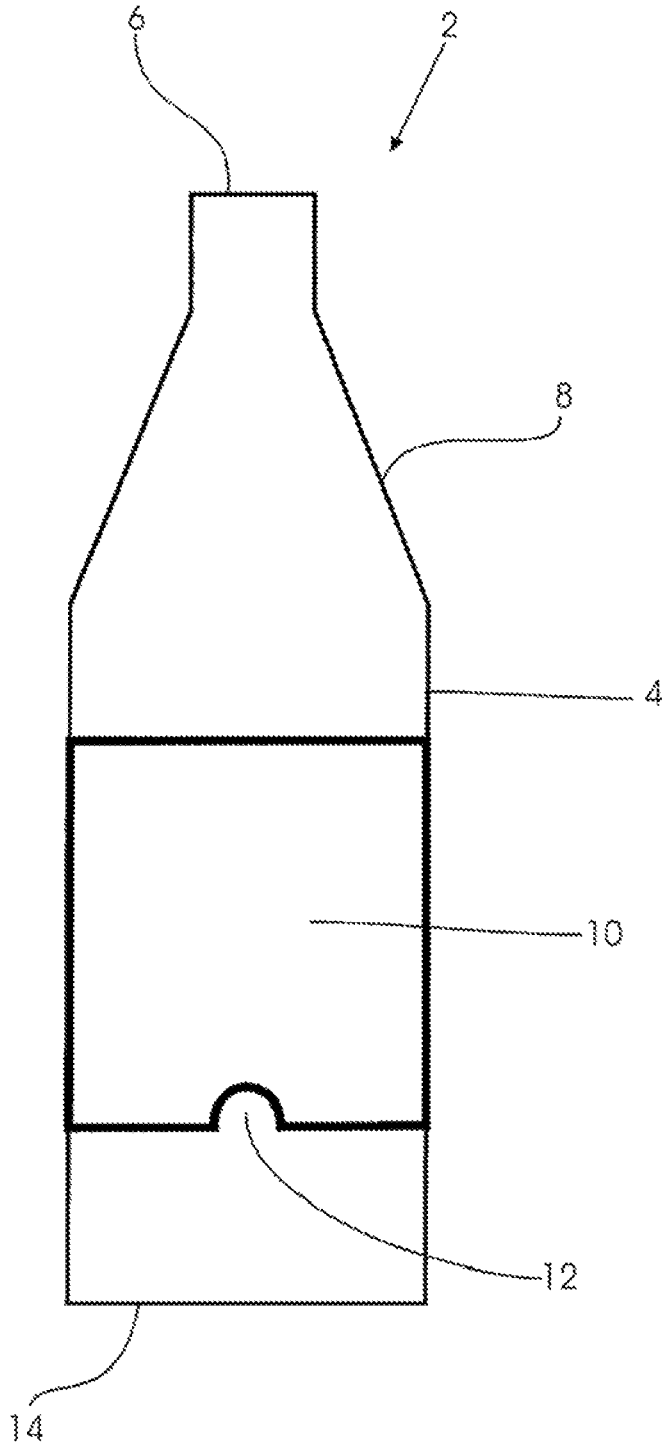
FIG. 1 shows a container with a label.

FIG. 1 shows a container 2 having a cylindrical body 4 and a shoulder region 8 on top of the body 4 and extending conically onto the bottleneck 6. The container 2 is made of PET (polyethylene terephthalate) with a wall thickness of 0.15 mm. Although the illustrated container 2 is a bottle, the principles described herein are applicable to other containers.

A thin plastic label 10 surrounds the body 4. As a result of its construction, the label 10 has relatively low tensile strength. The label's length is such that it lies snugly in contact around the body 4. Although its ends are adhesively bonded or welded together, in general, no adhesive bonds the label 10 to the container 2. Typically, the label 10 is a roll-fed label.

The label 10 comes from from an endless roll that has been printed with information regarding the the container 2. To label a container 2, a section of this roll is separated to form the label 10. The separated section is approximately as long as the container's circumference. A pair of punch pliers or another punching tool then forms a cut-out section 12 at a particular location on the label 10. A suitable locations is its edge, preferably at a location that does not contain any important information.

The cut-out section 12 is configured as a semi-circular or U-shaped gap that passes through the banderol's edge. In some embodiments, the diameter of the cut-out section 12 is between 5 mm and 50 mm. In others, it is between 10 mm and 30 mm. In the illustrated embodiment, the cut-out section 12 is punched out with a diameter of 20 mm. After formation of the cut-out section 12, the label 10 is separated from the endless roll, for example by cutting it off the roll.

The label 10 is then laid around the body 4 and its ends bonded to each other by adhesive, which is applied onto an end section of the label 10. The label 10, which essentially covers the lower half of the container 2, is arranged in such a way that the cut-out section 12 is located at the lower edge of the label 10, namely the edge that is nearest the container's lower end 14.

A rotating disk then aligns the container 2, which has now had the label 10 applied to it. It does so having an optical detection device identify the cut-out section 12. To facilitate this, the cut-out section's color differs from that of the label 10. The rotating disk then rotates the container 2 so that an adhesive nozzle deposits an adhesive point 13 into the cut-out section 12.

The process of joining two containers requires first and second containers, each of which has a label as described in connection with FIGS. 1 and 2, and each of which has been aligned in an identical manner. In this situation, one or more adhesive points 13 are applied. Following this, or at the same time, the second container is also aligned in such a way that, when the containers are joined, holding devices, clamping strips, or the like, which incur a shaping effect, cause the adhesive points 13 to come in contact in the cut-out section 12, or the adhesive application there, in the label of the second container. Hardening or cross-linking of the adhesive then forms a glue joint or an adhesive point. This adhesive point connects the two containers.

The cut-out section 12 is applied in the lower half of the container 2, nearer to its lower end 14 than its upper end, namely the container neck 6.

The cut-out section 12 allows adhesive points to also be applied in those regions in which the label 10 covers the container 2, i.e. related to the height of the container 2, between the container's neck 6 and its lower end 14, in the lower and middle regions of the container 2. It is advantageous that the label is not damaged when the containers are detached from one another.

Figure 2:
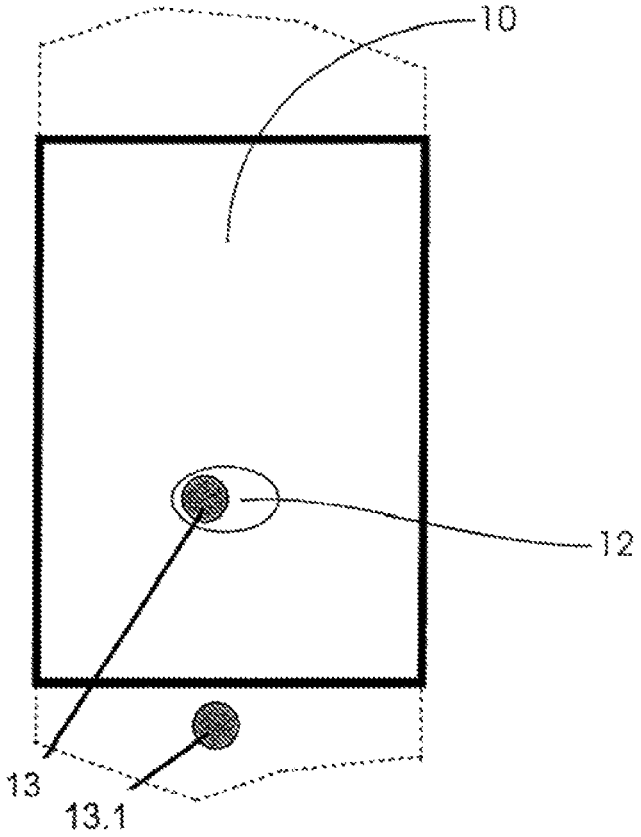
FIG. 2 shows a label.

FIG. 2 shows a paper label 10 that has been adhesively bonded onto a container. The paper label 10 is approximately 10 centimeters wide and approximately 15 centimeters high. The cut-out section 12 is already cut into the label 10 during production. In this embodiment, the cut-out section is an oval or elliptical hole having a minor axis of about 15 millimeters and a major axis of about 30 millimeters. The label 10 forms the edge of the cut-out section 12. However, in this case, the cut-out section 12 is not at the edge of the label 10.

The label 10 is adhesively bonded onto a container, and the container is aligned, by the detection of the differences in the light permeability, in such a way that an adhesive point 13 can be arranged in the cut-out section 12. The adhesive point 13 is then, after joining with a second container, hardened to form a glued joint.

In some cases, it is useful to provide more than one adhesive point. This is useful in cases in which the containers are very heavy and also in cases where one may wish to use leverage to detach containers. Such configurations can be achieved by combining the features of FIGS. 1 and 2. As a rule, An additional adhesive point is provided in the region of the label on the container surface, depending on the respective loading force, and the adhesive strength that is therefore required due to, for example, different container volumes.

In some embodiments, it is useful to place the e further adhesive points 13.2 between the container's base and bottom of the label. This permits one to exploit the advantageous leverage effect when detaching the containers from the cluster pack.

Accordingly, a method is also encompassed for producing a cluster pack out of containers 2. This comprises, among other elements, a sensor unit for detecting surface features of the containers and/or equipment elements carried by the containers, and is, in particular, a camera system, which scans the container surface and compares the data, by means of a control unit, with the data relating to the angular position of the container 2, and is available to the respective treatment steps. This takes place by means of suitable holding and alignment units for rotating and aligning the containers 10 about a container axis.

Also provided for is at least one unit for applying adhesive points 10 onto the container surface, as well as a hardening and compacting unit that holds a group of containers 2 in position, pressing them against each other as it does so, at least temporarily, until the adhesive has adequately dried and/or hardened. At that point, the cluster is once again released.

The cluster packs according to one of the foregoing embodiments are formed by equipping containers with labels, each of which has a cut-out section. These cut out sections can be manufactured as part of the label itself. Of, they can be added by providing a cutting station immediately before the application of the label onto the container.

Ideally, any such cutting station is an integral constituent of the labeling module. The cutting station can either cut, punch, or even burn the cut-out section of the label. Various implementations of a cutting station include rotating perforation tools, laser cutter burners, etc. A suitable transport or suction means removes the residue.

The adhesive point for connecting two containers 2 is applied onto the container surface in such a way that it comes to lie at least partially in the region of a cut-out section on the container surface. The containers that are to be connected are oriented in such a way and subsequently brought together and compacted such that the adhesive point that forms a glued joint, or the two or more adhesive points that, together, form a common glued joint or bridge will do so in the region of at least one cut-out section of two adjacent containers.

As an alternative, two or more adhesive points, that form a common glued joint or bridge are arranged in the region of two opposed cut-out sections of two adjacent containers.

In this situation it is advantageous if, in order to increase the adherence strength, at least one further application of adhesive is provided on at least one of two containers that are to be joined. Thus further application of adhesive is in the region outside the label. Ideally, it is beneath the label in the region between the lower label end and the container base.

In this situation, with all the foregoing embodiments and variants, the application of the labels with the cut-out sections can take place in one or a plurality of separated labelling machines arranged upstream of the device for the container alignment and the application of the adhesive points, or it can take place in an individual treatment device.

Having described the invention, and a preferred embodiment thereof, what is claimed as new, and secured by Letters Patent is:

1. A manufacture comprising a cluster pack, wherein said cluster pack includes a first container, a second container, a first label, a second label, and a glued joint, wherein said first container carries said first label and said second container carries said second label, wherein said glued joint interconnects said first and second containers, wherein said glued joint is applied in a region of said first label, and wherein said first label comprises a cut-out section in a region of said glued joint.

2. The manufacture of claim 1, wherein said cut-out section occupies up to 5% of a surface area of said first label.

3. The manufacture of claim 1, wherein said cut-out section occupies up to 10% of a surface area of said first label.

4. The manufacture of claim 1, wherein said cut-out section occupies up to 20% of a surface area of said first label.

5. The manufacture of claim 1, wherein said cut-out section is larger than said glued joint.

6. The manufacture of claim 1, wherein said cut-out section is larger than said glued joint by at least by 10%.

7. The manufacture of claim 1, wherein said cut-out section is larger than said glued joint by at least by 20%.

8. The manufacture of claim 1, wherein said cut-out section is larger than said glued joint by more than 20%.

9. The manufacture of claim 1, wherein said cut-out section intersects an edge of said first label.

10. The manufacture of claim 1, wherein said cut-out section is in said first label.

11. The manufacture of claim 1, wherein said first container has a height that defines a lower half thereof, and wherein said glued joint is arranged in said lower half.

12. A method for producing a cluster pack, said method comprising providing a first container, applying, to said first container, a first label with a cut-out section, applying an adhesive point in said cut-out section, wherein said first container is aligned before said first label is applied to said container, said container has been aligned in such a way that adhesive can be applied in said cut-out section, providing a second container, and joining said first and second containers to form a cluster pack.

13. The method of claim 12, further comprising forming said cut-out section in said label during manufacture of said label.

14. The method of claim 12, further comprising forming said cut-out section in said label after said label has been manufactured but before applying said label on said first container.

15. The method of claim 12, further comprising executing a labeling step and executing an alignment step, wherein said labeling step comprises labeling said second container with a second container label, wherein said alignment step comprises aligning said second container, wherein said alignment step is executed before joining said first and second containers, wherein aligning said second container comprises positioning said second container so as to form a glued joint in said cut-out section of said container label of said second container, wherein said second container label has a cut-out section.

16. The method of claim 12, wherein said adhesive point is one of a plurality of adhesive points, said method further comprising placing at least one of said adhesive points from said plurality of adhesive points in a region of two opposing cut-out sections of two adjacent containers.

17. The method of claim 12, wherein said adhesive point is one of a plurality of adhesive points, said method further comprising placing at least one of said adhesive points in a region outside of said label.

18. The method of claim 12, further comprising placing an additional adhesive point in a region below a lower edge of said label.

* * * * *